United States Patent [19]

Guyot et al.

[11] 3,982,388

[45] Sept. 28, 1976

[54] DIGITAL DISPLAY MECHANISM FOR A TIME-KEEPER

[75] Inventors: Charles Guyot, Tavannes; Jacques Muller, Reconvilier, both of Switzerland

[73] Assignee: Ebauches Tavannes SA, Tavannes, Switzerland

[22] Filed: Feb. 28, 1975

[21] Appl. No.: 554,139

[30] Foreign Application Priority Data

Apr. 5, 1974 Switzerland ..... 4839/74

[52] U.S. Cl. ..... 58/85.5; 58/5; 58/58; 58/125 B

[51] Int. Cl.[2] ..... G04B 27/06; G04B 19/24; G04B 19/02

[58] Field of Search ..... 58/4 R, 4 A, 4 M, 5, 58/58, 85.5, 125 B; 40/34, 107, 115

[56] References Cited

UNITED STATES PATENTS 2,633,696 4/1953 Youhouse ..... 58/125 B 3,775,966 12/1973 Matsuura ..... 58/58

*Primary Examiner*—E. S. Jackmon

*Attorney, Agent, or Firm*—Imirie, Smiley & Linn

[57] ABSTRACT

An instantaneous or step by step display mechanism for a time-keeper, including a constantly rotating driving wheel, a toothed wheel fixed to a first indication disc, a ratchet wheel also fixed to the indication disc, and a lever pivoted at one end, and carrying a dog engaging with the ratchet wheel, and an intermediate toothed wheel, at the other end. The intermediate wheel meshes with both the driving and indication disc wheels and when in use constantly runs up the indication disc wheel, carrying its end of the lever with it until the dog frees one tooth of the ratchet wheel, whereupon the lever falls back, advancing the display by one figure. The stem of the watch, when pulled, disengages the dog from the ratchet wheel and allows correction of the display, forwards or backwards. Minute, hour or date wheels may be provided.

7 Claims, 4 Drawing Figures

DIGITAL DISPLAY MECHANISM FOR A TIME-KEEPER

BACKGROUND OF THE INVENTION

The present invention concerns an instantaneous or step by step digital display mechanism for a time-keeper, comprising at least one first indication disc juxtaposed to at least one second indication disc.

In a known seconds display mechanism a movable lever is provided with a pallet which engages with the teeth of a wheel with which there is also engaged a toothed wheel rotatably mounted on that movable lever. The movable lever causes step by step rotation of said wheel, each step being equal to the distance between two adjacent teeth.

The above display is adapted only to a seconds display mechanism, because for each step the wheel makes only a very small rotation equal to the distance between two teeth. On the other hand, the attrition of the teeth of the pallet and the toothed wheel will be very rapid. Finally, with this system the resetting of the display can be effected only in one direction, i.e., that of the normal running of the watch.

SUMMARY OF THE INVENTION

The object of the present invention is to remedy these disadvantages and to provide a mechanism which also readily provides forward or backward resetting of the display.

In accordance with the present invention there is provided an instantaneous digital display mechanism for a time-keeper comprising a first indication disc, a second indication disc adjacent thereto, drive mechanism including a first toothed wheel connected to said first indication disc, a driving wheel, an intermediate wheel in engagement with said first toothed wheel and said driving wheel, a main lever on which said intermediate wheel is pivoted, a ratchet wheel connected to said first indication disc, a dog on said main lever engageable with the teeth of said ratchet wheel, and means to correct said display mechanism, said dog being disengageable from said ratchet wheel either by the automatic displacement of the said main lever during normal working or by the displacement of the said lever by the said means to correct said display mechanism.

The accompanying drawings show an embodiment of a mechanism forming the subject of the invention.

Figure 1:
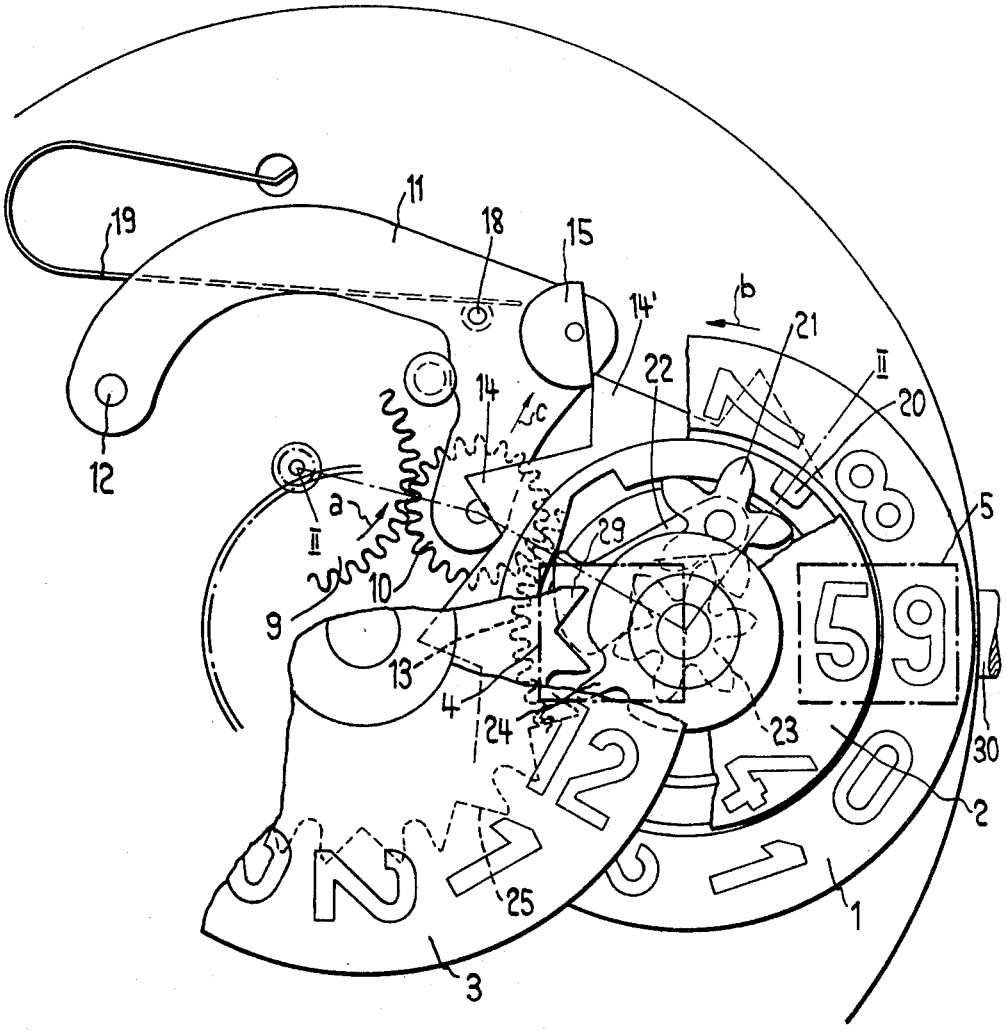
FIG. 1 is a partial plan view of a display assembly according to the present invention showing the mechanism just before the instantaneous jump of the units and tens discs.
Figure 2:
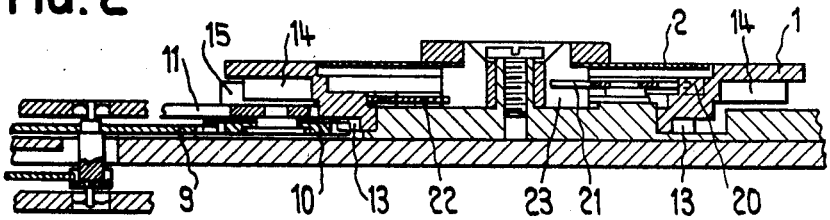
FIG. 2 is a partial section sectional view taken on the line II—II of FIG. 1.

Referring first to FIGS. 1 and 2, there can be seen that the mechanism comprises a units disc or ring 1 placed concentrically with a tens disc 2 which co-operates by means which will be described later, with an hours disc 3. The three discs 1, 2 and 3 carry markings which come sequentially beneath two apertures 4 and 5 (marked by a chain dotted line) of a dial (not shown) which covers the discs 1, 2, 3. A driving wheel which is part of a mechanically or electrically driven gear train movement drives in direction of the arrow *a* an intermediate wheel 10 freely mounted on a main lever 11 which pivots around a pin 12.

The intermediate wheel 10 meshes with the teeth 13 of a pinion which is integral with the units disc 1 on which are printed the numbers (partially shown) 0 to 9. The units disc 1 is provided with a ratchet wheel 14 having ten teeth 14' one of which is at any time in contact with a dog 15 fixed on the lever 11. When this dog 15 drops into the teeth 14' of the ratchet wheel 14 it instantaneously locks the units disc 1 against movement in the direction of the arrow *b*.

At this time the pinion 13 is momentarily locked by the ratchet wheel 14 engaged by the dog 15, so the lever 11 is moved in the direction of the arrow *c* by the driving wheel 9. This produces sliding of the dog 15 along the face of a tooth 14' up to the point when the said tooth 14' becomes free of the dog. A spring 14 now pushes the lever 11 down in the opposite direction to the arrow *c* by acting on a rivet stud 18. The intermediate wheel 10 now turns the pinion 13 and the units ring 1 till the dog 15 on the lever 11 again comes into contact with the next tooth of the ratchet wheel 14.

The units ring 1 has thus instantaneously changed digits.

After each complete rotation of the units ring 1, a finger 20 advances a driving pinion 21, a "tens" pinion 23 and a "tens" disc 2 which carries the numbers 0 to 5, the latter rotating by a sixth of a turn. The static positions of the tens pinion and the tens disc are determined by a lever 22. On the tens pinion 23 there is a finger 24 (FIG. 1) which, once during each revolution, engages one of a plurality of slots formed in an hours click wheel 25. Finger 24 thus instantaneously drives by a twelfth of a turn, click wheel 25 which is integral with the hours disc 3; this disc carries the FIGS. 1 to 12 and is partially shown in FIGS. 1 and 5. Here can also be seen the form of the teeth 29 of the hours wheel 25 which is locked against the effect of shock, by the outer circumference of the finger wheel 24 and acts in concert with a detent 100.

Figure 3:
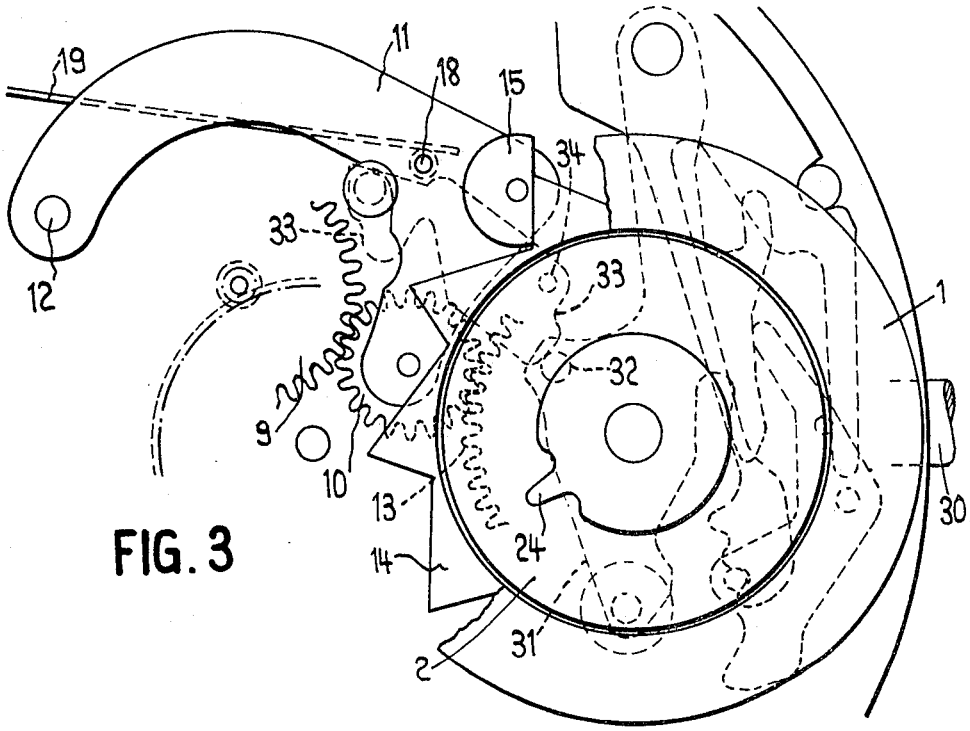
FIG. 3 is a partial plan view showing the time setting mechanism of the device of FIG. 1 during normal working.
Figure 4:
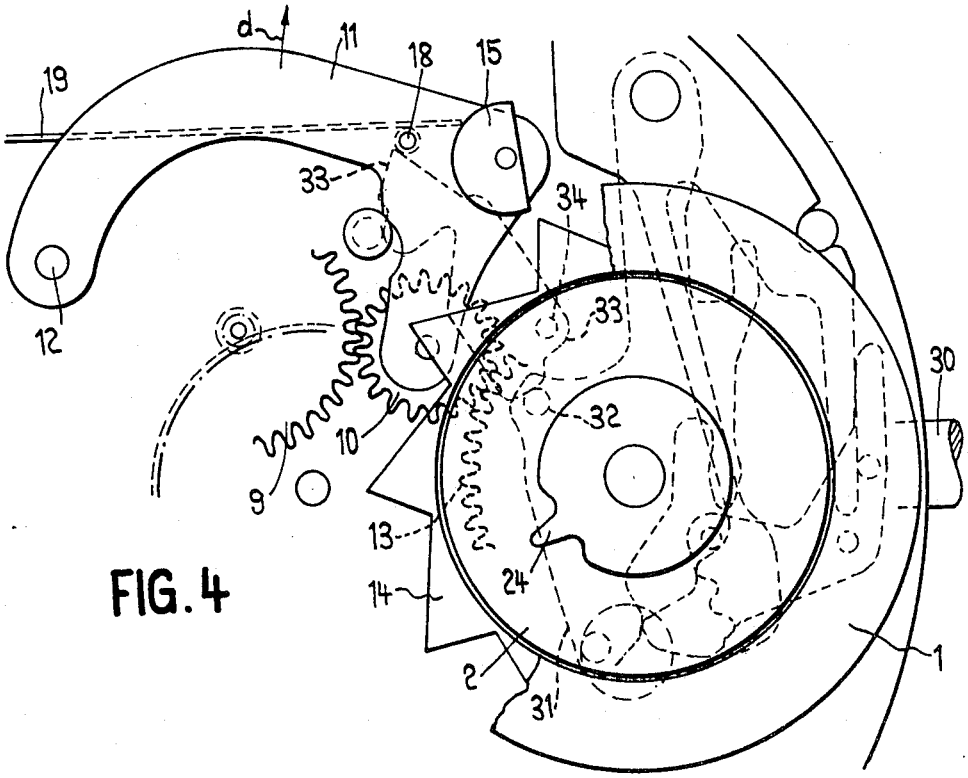
FIG. 4, is a partial plan view similar to FIG. 3 but showing the mechanism with the time setting shaft fully retracted.

FIG. 3 shows the units ring 1 and the tens disc 2 which hides the time setting mechanism involving three positions of the reset shaft 30. The shaft 30 when totally pushed in, provides normal working; in the intermediate position of the shaft the date (not shown) can be altered, and fully retracted, the time indication can be reset (FIG. 4). Consequently, and as shown in FIG. 3, when the reset shaft 30 is pushed right in, a first lever 31 can engage a second lever 33 pivoting around a pin 34 by the intermediary of a stud 32. The lever 33 is not actuated and acts as a safety device operating between the lever 31 and the stud 18 of the lever 11. As a result, lever 33 does not influence the position of the lever 11 and thus the stud 18 permits bending of the spring 19. The intermediate wheel 10 can thus co-operate normally with the pinion 13 and the driving wheel 9 to effect the stepwise advance of the units ring 1, the tens disc 2 and the hours disc 3 respectively.

In FIG. 4 the time setting shaft 30 is entirely retracted to the time setting position; this produces a rotational movement of the second lever 33 around its pivot pin 34 by means of the stud 32 of the time setting first lever 31, this rotational movement producing movement of the main lever 11 in the direction of the arrow *d* by the intermediary of the stud 18, and consequently the disengagement of the dog 15 from the teeth 14' of the wheel 14.

When the time setting shaft 30 is turned, the wheel 9 is driven by a known train of intermediate wheels (not shown). This wheel co-operates with the intermediate wheel 10 and thus drives in turn the pinion 13 which is integral with the units ring 1. It is thus possible to rotate the units wheel 1, the tens disc 2 and the hours disc 3 (FIG. 1) in a forward or backward direction. The time setting shaft 30 is then returned to its pushed-in position (FIG. 3) and normal working of the mechanism is resumed as shown in FIGS. 1 and 3. When the lever 11 and the dog 15 are returned into their normal working positions, the units ring is advanced by one extra step, which must be taken into consideration when time setting.

In an alternative embodiment it is possible to replace the units ring 1 and the tens disc 2 by one or two date discs, thus providing an instantaneously acting calendar.

We claim:

1. An instantaneous digital display mechanism for a time-keeper comprising a first indication disc, a second indication disc adjacent thereto, dirve mechanism including a first toothed wheel connected to said first indication disc, a driving wheel, an intermediate wheel in engagement with said first toothed wheel and said driving wheel, a main lever on which said intermediate wheel is pivoted, a ratchet wheel connected to said first indication disc, a dog on said main lever engageable with the teeth of said ratchet wheel, and means to correct said display mechanism, said dog being disengageable from said ratchet wheel by the automatic displacement of the said main lever by cooperation of said driving wheel, said intermediate wheel and said first toothed wheel during normal working and also by the manual displacement of the said main lever by the said means to correct said display mechanism.

2. A display mechanism as recited in claim 1, characterized in that the automatic displacement of said main lever is effected by said intermediate wheel, which by engagement with said first toothed wheel and said driving wheel, starts turning and causes pivoting of said main lever, and a spring action on said main lever to produce stepping of said ratchet wheel connected to said first indication disc.

3. A display mechanism as recited in claim 1, wherein said manual displacement is effected by a time resetting shaft operating a time resetting first lever, a stud on said first lever cooperating with a second lever actuation of which causes pivoting of said main lever and disengagement of said dog from the teeth of said ratchet wheel, thus freeing said display mechanism for time resetting correction in either direction.

4. A display mechanism as recited in claim 1, characterized in that said first indication disc is a units disc placed concentrically with respect to said second indication disc which acts as a tens disc.

5. A display mechanism as recited in claim 1, wherein said first indication disc is an instantaneous date disc.

6. A display mechanism as recited in claim 4, characterised in that said tens and units discs indicate a date.

7. A display device as recited in claim 1, comprising an hours disc, a finger wheel for said hours disc, said finger wheel having a drive finger and an outer circumference locking said hour wheel when not driven, and means for driving said finger wheel.

* * * * *